US007438777B2

(12) United States Patent
Pourdeyhimi et al.

(10) Patent No.: US 7,438,777 B2
(45) Date of Patent: Oct. 21, 2008

(54) LIGHTWEIGHT HIGH-TENSILE, HIGH-TEAR STRENGTH BICOMPONENT NONWOVEN FABRICS

(75) Inventors: Behnam Pourdeyhimi, Cary, NC (US); Nataliya V. Fedorova, Kiev (UA); Stephen R. Sharp, Holly Springs, NC (US)

(73) Assignee: North Carolina State University, Raleigh, NC (US)

( * ) Notice: Subject to any disclaimer, the term of this patent is extended or adjusted under 35 U.S.C. 154(b) by 190 days.

(21) Appl. No.: 11/096,954

(22) Filed: Apr. 1, 2005

(65) Prior Publication Data

US 2006/0223405 A1 Oct. 5, 2006

(51) Int. Cl.
*B32B 37/00* (2006.01)

(52) U.S. Cl. ..... 156/148; 156/167; 156/181; 156/296; 156/309.6

(58) Field of Classification Search ..... 156/148, 156/296, 308.2, 309.6, 167, 181, 166
See application file for complete search history.

(56) References Cited

U.S. PATENT DOCUMENTS

| | | | | |
|---|---|---|---|---|
| 3,629,047 | A | 12/1971 | Davison | |
| 3,724,198 | A | 4/1973 | Kim | |
| 3,751,777 | A | 8/1973 | Turmel et al. | |
| 3,829,324 | A | 8/1974 | Blais et al. | |
| 3,855,046 | A | 12/1974 | Hansen et al. | |
| 3,914,365 | A | 10/1975 | Kim et al. | |
| 4,102,969 | A | 7/1978 | Neveu et al. | |
| 4,211,816 | A * | 7/1980 | Booker et al. | 156/167 |
| 4,274,251 | A | 6/1981 | Kim et al. | |
| 4,551,378 | A | 11/1985 | Carey, Jr. | |
| 4,555,430 | A * | 11/1985 | Mays | 28/103 |
| 4,866,107 | A | 9/1989 | Doxsee et al. | |
| 5,009,239 | A | 4/1991 | Cohen et al. | |
| 5,045,387 | A | 9/1991 | Schmalz | |
| 5,141,522 | A | 8/1992 | Landi | |
| 5,334,177 | A | 8/1994 | Cohen | |
| 5,336,552 | A | 8/1994 | Strack et al. | |
| 5,403,426 | A | 4/1995 | Johnson et al. | |
| 5,470,640 | A | 11/1995 | Modrak | |

(Continued)

FOREIGN PATENT DOCUMENTS

| | | |
|---|---|---|
| EP | 0 696 629 A1 | 2/1996 |

(Continued)

OTHER PUBLICATIONS

Hegde, et al "Bicomponent Fibers". from the wesite http://web.utk.edu/~mse/pages/Textiles/Bicomponent%20fibers.htm, Apr. 2004,10 pages.*

(Continued)

*Primary Examiner*—Jeff H Aftergut
(74) *Attorney, Agent, or Firm*—Alston & Bird LLP

(57) ABSTRACT

A method of producing a nonwoven fabric comprising spinning a set of bicomponent fibers which include an external fiber component and an internal fiber component. The external fiber enwraps said internal fiber and has a higher elongation to break value than the internal fiber and a lower melting temperature than the internal fiber component. The set of bicomponent fibers are positioned onto a web and thermally bonded to produce a nonwoven fabric.

24 Claims, 10 Drawing Sheets

U.S. PATENT DOCUMENTS

| | | | | |
|---|---|---|---|---|
| 5,472,995 | A | 12/1995 | Kaminski et al. | |
| 5,582,904 | A | 12/1996 | Harrington | |
| RE35,621 | E | 10/1997 | Schmalz | |
| 5,721,048 | A | 2/1998 | Schmalz | |
| 5,786,065 | A | 7/1998 | Annis et al. | |
| 5,827,443 | A | 10/1998 | Kita et al. | |
| 5,869,010 | A | 2/1999 | Langer | |
| 5,889,080 | A | 3/1999 | Kaminski et al. | |
| 5,916,678 | A | 6/1999 | Jackson et al. | |
| 5,919,837 | A | 7/1999 | Kaminski et al. | |
| 5,972,497 | A | 10/1999 | Hirwe et al. | |
| 6,110,991 | A | 8/2000 | Kaminski et al. | |
| 6,465,094 | B1 | 10/2002 | Dugan | |
| 6,506,873 | B1 | 1/2003 | Ryan et al. | |
| 6,607,859 | B1 * | 8/2003 | Tanaka et al. | 429/145 |
| 6,632,313 | B2 | 10/2003 | Nickel et al. | |
| 7,291,300 | B2 | 11/2007 | Chhabra et al. | |
| 2002/0006502 | A1 | 1/2002 | Nagaoka et al. | |
| 2004/0266300 | A1 | 12/2004 | Isele et al. | |
| 2005/0070866 | A1 | 3/2005 | Isele et al. | |
| 2006/0014460 | A1 | 1/2006 | Isele et al. | |
| 2006/0057922 | A1 | 3/2006 | Bond et al. | |
| 2006/0084340 | A1 | 4/2006 | Bond et al. | |
| 2007/0227359 | A1 | 10/2007 | Choi | |

FOREIGN PATENT DOCUMENTS

| | | | | |
|---|---|---|---|---|
| EP | 0 696 691 | A1 | | 2/1996 |
| GB | 1 311 085 | | | 3/1973 |
| GB | 1 323 296 | | | 7/1973 |
| JP | 10-251921 | A | * | 9/1998 |
| WO | WO 2005/004769 | A1 | | 1/2005 |

OTHER PUBLICATIONS

"Strength Loss in Thermally Bonded Polypropylene Fibers;" Inter Nonwovens Journal, 2000; 9(3); pp. 27-35; by Aparna Chidambaram, Hawthorne Davis and Subhash K. Batra.

* cited by examiner

Sheath/core (1 island-in-sea), 75/25% Nylon/PE 36 islands-in-sea, 50/50% Nylon/PE 18 islands-in-sea, 50/50% Nylon/PE 108 islands-in-sea, 75/25% Nylon/PE

LIGHTWEIGHT HIGH-TENSILE, HIGH-TEAR STRENGTH BICOMPONENT NONWOVEN FABRICS

TECHNICAL FIELD

The subject matter disclosed herein relates generally to nonwoven fabrics used in applications wherein high tensile and high tear properties are desirable such as outdoor fabrics, house wrap, tents, awning, parachutes, and the like. More particularly, the present subject matter relates to methods for manufacturing high strength, durable nonwoven fabrics and products produced thereof with high abrasion resistance through the use of bicomponent spunbonded fibers having different melting temperatures and wherein the fibers are manipulated such that one component forms a matrix enveloping a second component.

BACKGROUND

Nonwoven fabrics or webs have a structure of individual fibers or threads which are interlaid, but not in a regular or identifiable manner as in a woven fabric. Nonwoven fabrics or webs have been formed from many processes which include meltblowing, spunbonding and air laying processes. The basis weight of fabrics is usually expressed in grams per square meter.

Nonwoven spunbonded fabrics are used in many applications and account for the majority of products produced or used in North America. Almost all such applications require a lightweight disposable fabric. Therefore, most spunbonded fabrics are designed for single use generally requiring minimum bond strength and are designed to have adequate properties for the applications for which they are intended. Spunbonding refers to a process where the fibers, filaments, are extruded, cooled, and drawn and subsequently collected on a moving belt to form a fabric. The web thus collected is not bonded and the filaments must be bonded together thermally, mechanically or chemically to form a fabric. Thermal bonding is by far the most efficient and economical means for forming a fabric. Hydroentangling is not as efficient, but leads to a much more flexible and normally stronger fabric when compared to thermally bonded fabrics. Thermal bonding is one of the most widely used bonding technologies in the nonwovens industry. It is used extensively in spunbond, meltblown, air-lay, and wet-lay manufacturing as well as with carded-web formation technologies. Considerable effort has been spent on trying to optimize the web-formation processes, bonding processes, and the feed fiber properties to achieve the desired end-use properties while reducing the cost of manufacture. One way to reduce the cost of manufacture is to produce more nonwoven fabric on the same machine by processing faster. It has been found that satisfactory bonds can be made faster at higher temperatures, up to a point, after which satisfactory bonds can no longer be made. This is sometimes described as "the bonding window closes as the bonding temperature increases". The processing window at a given process speed is defined by the maximum and minimum process temperatures that produce nonwovens with acceptable properties. In other words, it has been found that as one attempts to process faster, the difference between the maximum and minimum process temperatures gets smaller until they merge into a single temperature. At still higher speeds, no suitable nonwoven can be made, regardless of the bonding temperature, i.e. the processing window closes.

In addition, over the last 100 years of modern fiber science, it has been learned that stronger fibers generally make stronger textile structures when all the other construction factors are the same. This applies to cords, ropes, knits and wovens. In addition, for melt-spun fibers, it is possible to make stronger fibers by increasing fiber orientation and crystallinity, as well as achieving appropriate fibrillar morphology. This is typically accomplished by increasing the spinning speed, altering the quenching conditions, increasing the draw ratio and annealing the fibers under tension. Hence, it was unexpected when it was found that thermally point bonded nonwoven fabrics became weaker when high strength fibers were used and, conversely, yielded stronger fabrics with appropriate weaker fibers.

Part of the confusion about the strength of nonwovens can be attributed to the fact that the failure mode changes with bonding conditions. It has been observed that the strength of the bonded fabric increases with bonding temperature or with bonding time up to a point, and then the bonded fabric strength begins to decrease. For bonding conditions below this peak, failure occurs by bond disruption, i.e. the bond simply pulls apart. Above the peak, failure occurs by fiber breakage at the bond periphery. Several explanations for this latter observation have been provided. One explanation that has been forwarded is that there is a stress concentration at the bond periphery, where most failures occur. Although this is likely to be true, no satisfactory explanation of the dependence of the stress concentration on bonding conditions has been provided. Another proposed failure mechanism is that the fibers are crushed by the calendar rolls and thus weakened at the bond edge where the edges of the bond point flatten the fibers. However, as shown by Chidambaram, A., Davis, H., Batra, S. K., "Strength Loss in Thermally Bonded Polypropylene Fibers" Inter Nonwovens J 2000, 9(3) 27 this factor accounted for only a small portion of the loss of strength. Furthermore, bond strength did not correlate with bonding pressure, as one would expect for this failure mechanism. To date, no satisfactory explanation of the mechanical failure mechanisms of thermally point bonded nonwovens has been provided.

Thermal bonding can be performed in several ways. In through-air bonding, a hot fluid, air, is forced through a preformed web. If the temperature of the fluid is high enough, the fibers may become tacky and adhere to one another. In this case they form bonds where two or more fibers come into contact. In infrared bonding, IR-bonding, infrared light provides the heat. In ultrasonic bonding, friction between contacting fibers due to the application of ultrasound causes the fibers to become tacky and bond. In thermal point bonding, the preformed fiber web is passed between heated calendar rolls. The rolls may be smooth or embossed with a bonding pattern. A uniform fabric requires uniform pressure, uniform temperature and uniform input web. Bonding occurs only where the fibers contact the heated rolls. Therefore, on a smooth calendar roll, bonding occurs wherever fibers cross each other while on an embossed calendar roll, bonding occurs primarily between the raised areas. This results in bonding "points" or "spots". In each of these processes, the underlying physics is the same, the fibers are heated, they form a bond, and they are subsequently cooled.

Before bonding can occur, a web must be formed. The processes usually employed include spinning (spunbond), melt-blowing, wet-laying, air-laying and carding. Each of these produces different fiber orientation distribution functions (ODF) and web densities. It is important to recognize that there is an interaction between the web structure and the efficiency with which bonds are formed, i.e. bonding efficiency. In the simplest case where smooth calendar rolls are used, or in through-air bonding, the maximum level of bonding occurs when the structure is random since the maximum number of fiber-to-fiber crossovers is achieved. Thus, the more oriented the structure, the fewer the number of potential bond sites. The ODF also dictates, to a great extent, the manner in which the structure undergoes mechanical failure. While failure can follow different modes, the fabrics tend to fail by tearing across the preferred fiber direction when the load is applied parallel to the machine- or cross-directions. At all other test angles, failure is likely to be dictated by shear along the preferred direction of fiber orientation.

It is generally observed that the strength of the structure improves with bonding temperature, reaches a maximum, and then declines rapidly because of over-bonding and premature failure of the fibers at the fiber-bond interface. However, regardless of the bonding temperature, the changes brought about in the web structure and the microscopic deformations therein are driven by the initial ODF of the fibers, and therefore are similar for all structures with the same initial ODF. During load-elongation experiments the nature of the bonding process controls the point at which the structure fails, but the behavior up to that point is dictated by the structure (ODF) and the anisotropy of the bond pattern. Moreover, the structure stiffness, i.e. tensile modulus, bending rigidity and shear modulus, continues to increase with bonding temperature.

After the web is formed, it passes through the calendar rolls where it is bonded. Thermal point bonding proceeds through three stages: 1) compressing and heating a portion of the web, 2) bonding a portion of the web, and 3) cooling the bonded web. In calendar bonding, the bonding pressure appears to have little or no effect on fabric performance beyond a certain minimum. This is especially true for thin nonwovens where minimal pressure is required at the nip to bring about fiber-to-fiber contact. Sufficient pressure is needed to compact the web so that efficient heat transfer through conduction can take place. In addition, pressure aids plastic flow at elevated temperatures, thereby increasing contact area between the fibers as well as decreasing thickness at the bond even further. Pressure also aids "wetting" of the surfaces. This requires fairly minimal pressures. Pressure also constrains the mobility of the fibers in the bond spot. Over the range of pressures commercially employed, higher nip pressures do not necessarily lead to higher performance.

In calendar and through-air bonding, it is quite easy to obtain under-bonded or over-bonded structures. Under-bonding occurs when there are an insufficient number of chain ends in the tacky state at the interface between the two crossing fibers or there is insufficient time for them to diffuse across the interface to entangle with chains in the other fiber. The formation of a bond requires partial melting of the crystals to permit chain relaxation and diffusion. If, during bonding, the calendar roll temperatures are too low or if the roll speeds are too high, the polymer in the mid-plane of the web does not reach a high enough temperature to release a sufficient number of chains or long enough chain segments from the crystalline regions. Thus, there will be very few chains spanning the fiber-fiber interface, the bond itself will be weak, and the bonds can be easily pulled out or ruptured under load, as observed.

Over-bonding occurs when many chains have diffused across the interface and a solid, strong bond has been formed. The fibers within the bond spot, and at the bond fiber periphery, have lost their orientation and their strength, but the bond spot itself represents a more rigid and larger area compared to the fibers entering the bond spot. However, at the same time, the polymer chains within the fibers located in the vicinity of the bond, also relax to lower birefringence as heat diffuses along the fiber length. Thus the fibers entering the bond have also lost some of their molecular orientation and consequently their strength at the fiber-bond interface. The distance that sufficient heat diffuses along the fiber length subjected to heating depends on the time and temperature in the nip. It has been observed at high speeds, this distance should be less than the thickness of the nip, while at lower speeds the distance should be longer. Since the birefringence is only reduced where the temperature was high enough to start melting the crystals, it is only this region that has reduced strength. Thus the birefringence of the fibers is reduced only in the region close to the bond periphery and the fibers are weak only in this region. They may have also become flat and irregular in shape. The bond site edge becomes a stress concentration point where the now weaker fibers enter. In a fabric under load, this mechanical mismatch results in the premature failure of the fibers at the bond periphery, as observed. Simply put, over-bonding occurs when too much melting has occurred.

Thermal bonding of nonwoven webs occurs through three steps 1) heating the fibers in the web, 2) forming a bond through reptation of the polymer chains across the fiber-fiber interface, 3) cooling and resolidifying the fibers. In calendar bonding, step 1 must occur while the web is in the nip. Step 2 must begin while the web is in the nip to tie the structure together, but it can finish during the initial portion of step 3. There is excellent agreement between the required times for heating and forming the bond and commercial bonding times.

In under-bonded webs, there are too few polymer chains diffusing across the fiber-fiber interface. During tensile testing, these bonds simply disintegrate. In well-bonded webs there is sufficient diffusion of the chains across the interface to form a strong bond, but only a moderate loss of mechanical properties of the bridging fibers at the bond periphery. Hence there is an acceptable trade off between the strength of the bond and the strength of the fibers at the bond periphery. In over-bonded webs, there is sufficient diffusion of the chains across the interface to form a strong bond, but there is a large loss of mechanical properties of the bridging fibers at the bond periphery. During tensile testing, the fibers break at the bond periphery.

Hydroentangling results in somewhat different characteristics. The bonded fibers will be flexible and will have a higher strength than its calendar bonded counter part. The fabric does not go through shear failure as easily as thermally point bonded nonwovens.

Bicomponent nonwoven filaments are known in the art generally as thermoplastic filaments which employ at least two different polymers combined together in a heterogeneous fashion. Most commercially available bicomponent fibers are configured in a sheath/core, side-by-side or eccentric sheath/core arrangement. Instead of being homogeneously blended, two polymers may, for instance, be combined in a side-by-side configuration so that a first side of a filament is composed of a first polymer "A" and a second side of the filament is composed of a second polymer "B. Alternatively, the polymers may be combined in a sheath-core configuration wherein the outer sheath layer of a filament is composed of first polymer "A" and the inner core is composed of a second polymer "B".

Bicomponent fibers or filaments offer a combination of desired properties. For instance, certain resins are strong but not soft whereas others are soft but not strong. By combining the resins in a bicomponent filament, a blend of the characteristics may be achieved. For instance, when the bicomponent fibers are in a side-by-side arrangement these are usually used as self-bulking fibers. Self-bulking is created by two polymers within a filament having a different strain level or shrinkage propensity. Hence, during quenching or drawing they become crimped. Also, for some sheath/core configurations, the polymer utilized for the sheath component may have a lower melting point temperature than the core component. The outer component sheath component is heated to become tacky forming bonds with other adjacent fibers.

An additional bicomponent fiber is known as an islands-in-sea fiber. In such a configuration, a "sea" component forms the sheath, with the "island" components being the core or cores. Typically, islands-in-sea fibers are manufactured in order to produce fine fibers. The production of nanofibers in and of themselves is infeasible with current technology. Certain fiber size is necessary to insure controlled manufacturing. Accordingly, to produce nanofibers, islands-in-sea fibers consist of a sea component which is soluable and when removed results in the interior fibers being released. Also, it is known in some circumstances to maintain the sea component. U.S. Pat. No. 6,465,094 discloses a specific fiber construction which is of an islands-in-sea type configuration wherein the sheath, e.g. sea, is maintained to provide the fiber with distinct properties. Such a structure is akin to a typical bicomponent sheath/core construction with multi cores enabling certain fiber properties to be created.

While prior art bicomponent fibers are known, there is a need for a high strength, lightweight nonwoven fabric.

In view of the aforementioned, it is an object of the present invention to provide a method for producing high strength spunbonded nonwoven fabrics;

It is a further object of the present invention to establish a fiber construction which is bonded in a manner which enables the fiber to exhibit high tensile and tear strength characteristics previously unfounded in nonwoven fabrics.

SUMMARY

A method of producing a nonwoven fabric comprising spinning a set of bicomponent fibers which include an external fiber component and an internal fiber component. The external fiber enwraps said internal fiber and has a higher elongation to break value than the internal fiber and a lower melting temperature than the internal fiber component. The set of bicomponent fibers are positioned onto a web and thermally bonded to produce a nonwoven fabric.

DETAILED DESCRIPTION

Figure 5:
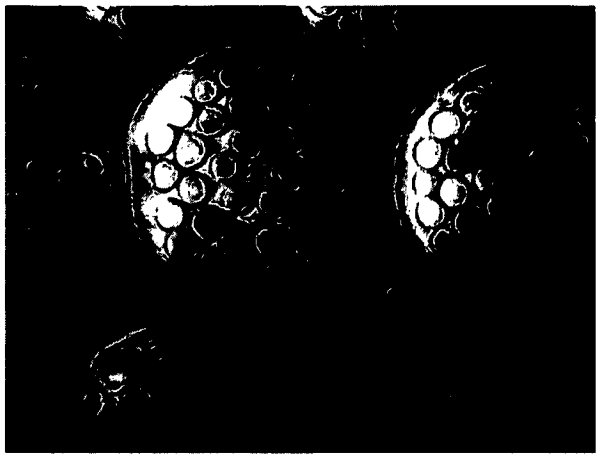
FIG. 5 shows cross-sectional view of bicomponent fibers produced according to the present invention.
Figure 5:
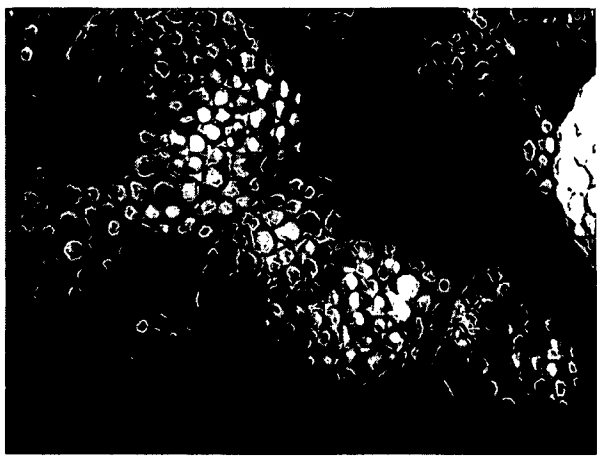
Figure 5:
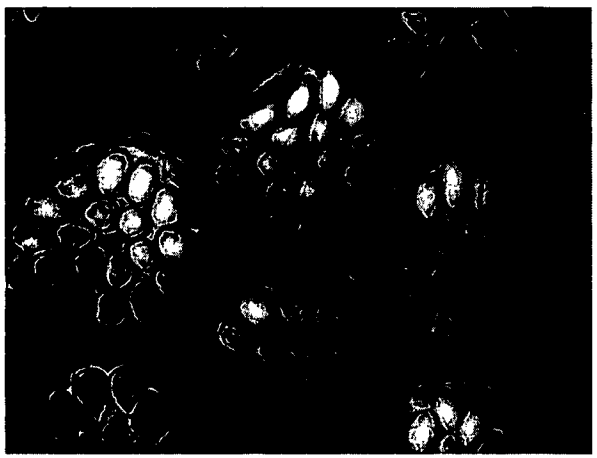
Figure 5:
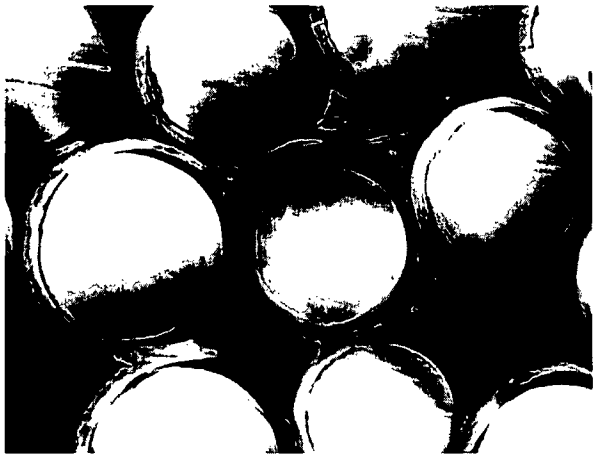
Figure 6:
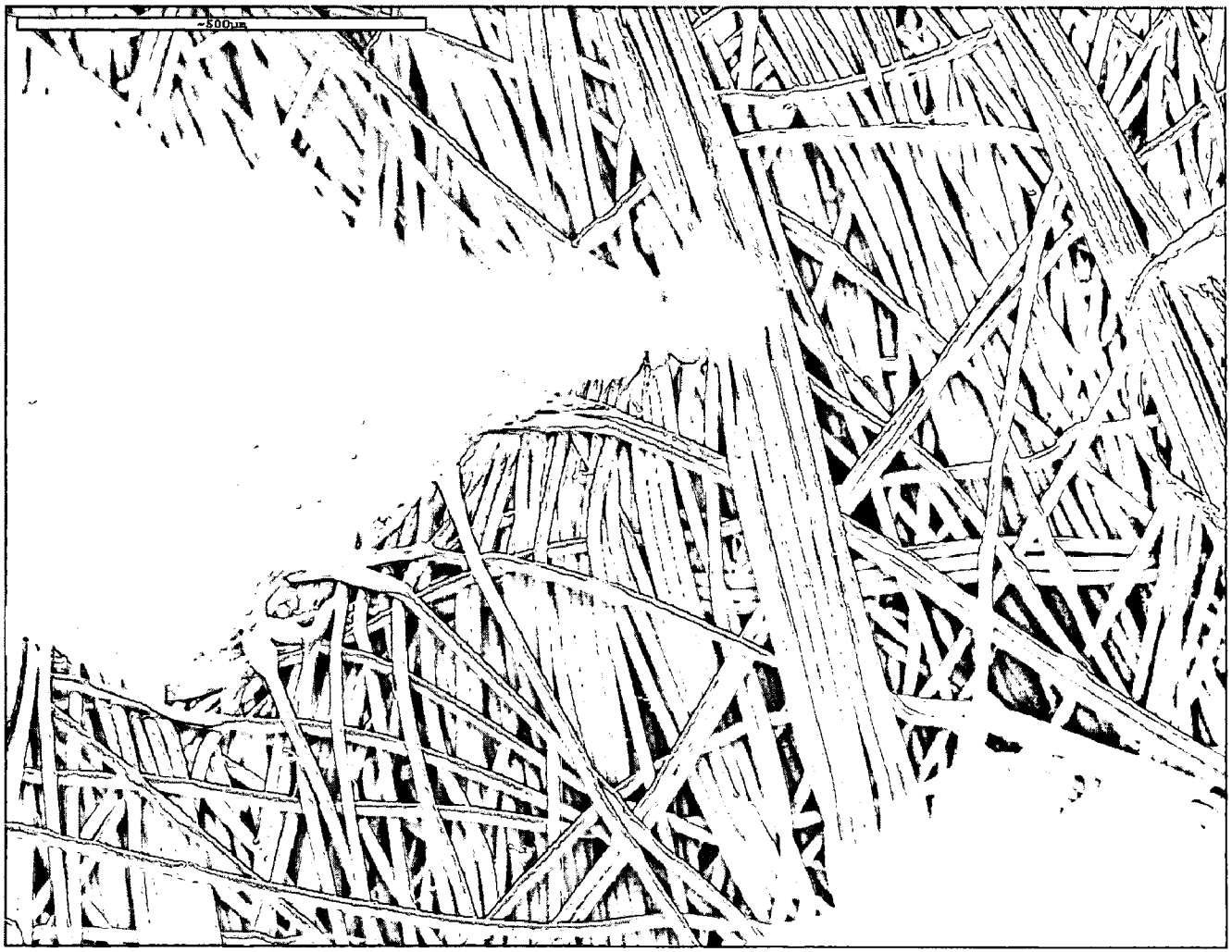
FIG. 6 shows a SEM Micrograph of the bonding and the bond fiber interface of a 108 island nylon/PE spunbonded fabric bonded thermally.
Figure 7:
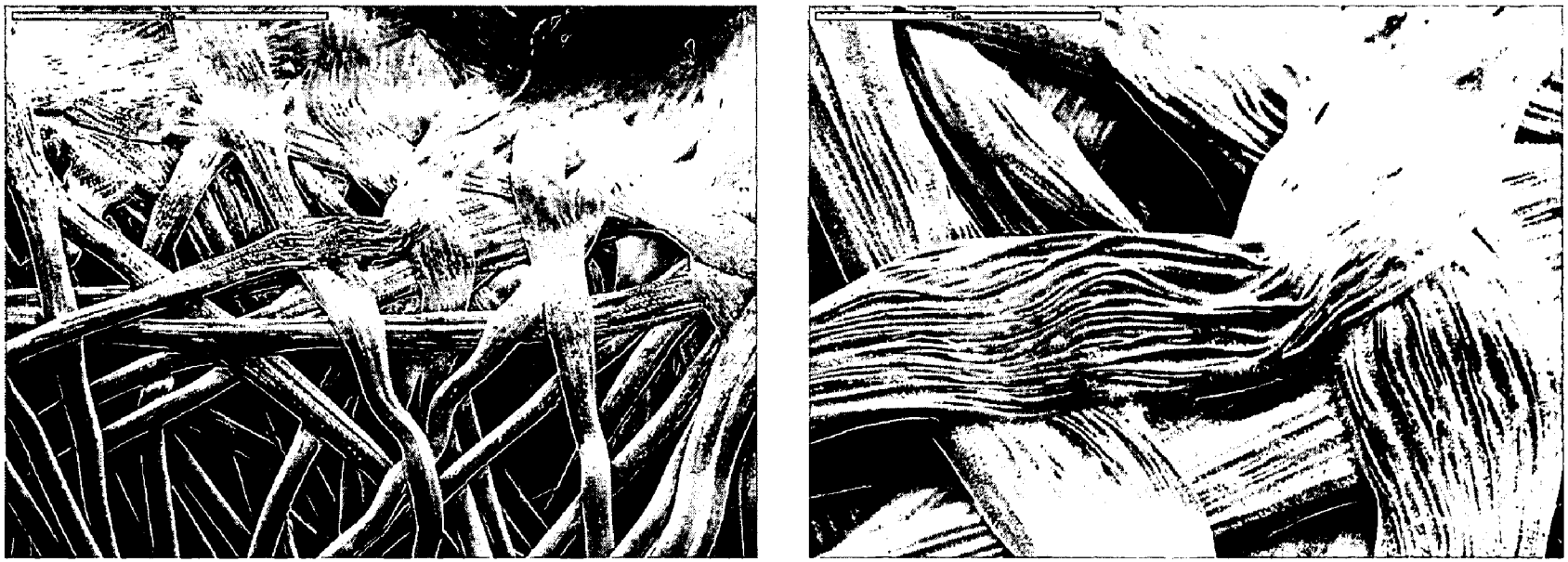
FIG. 7 shows SEM Micrographs of the bond spot of a 108 island nylon/PE spunbonded fabric bonded thermally.
Figure 8:
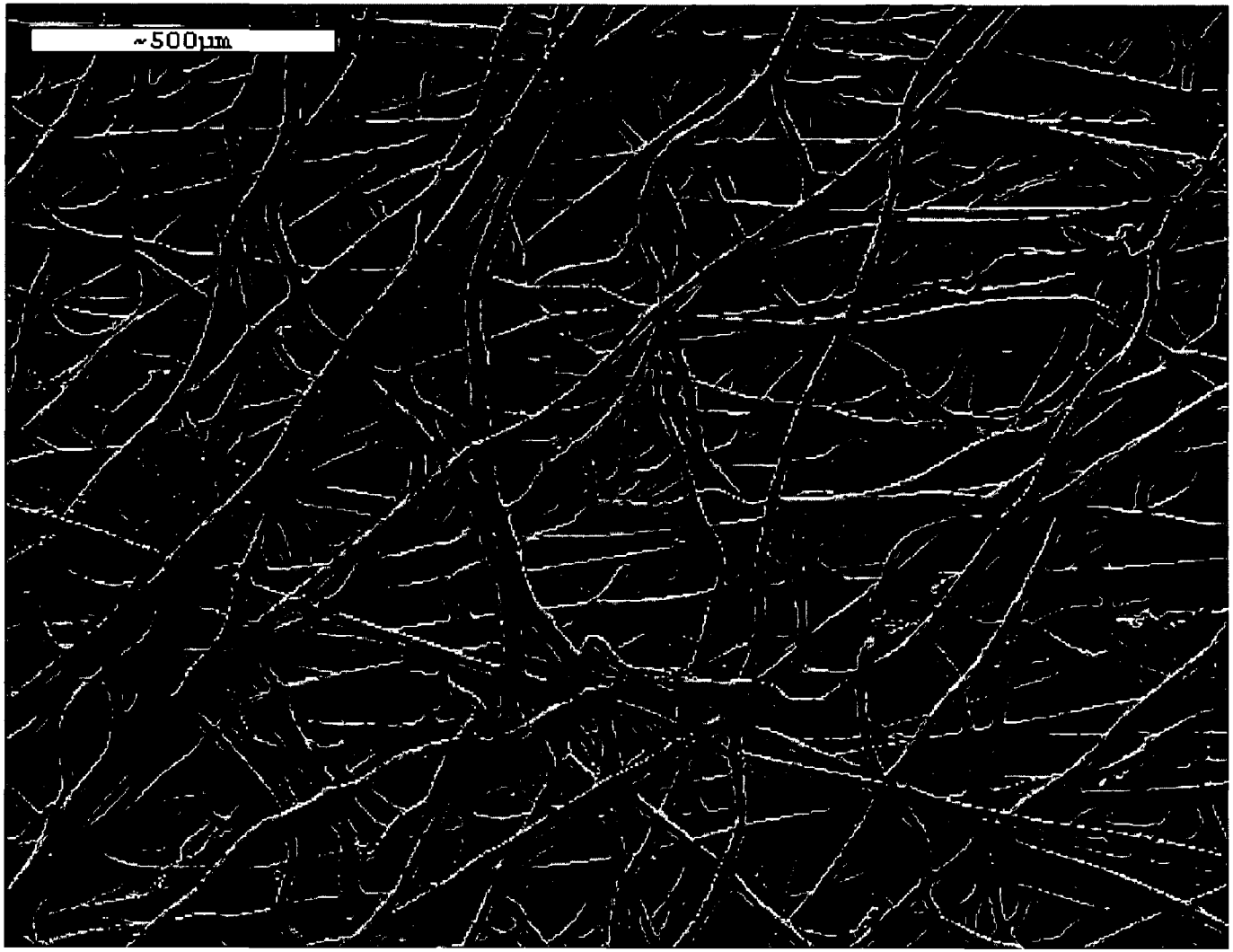
FIG. 8 shows SEM Micrographs of the surface of a thru-air bonded 108 island spunbonded fabric.
Figure 9:
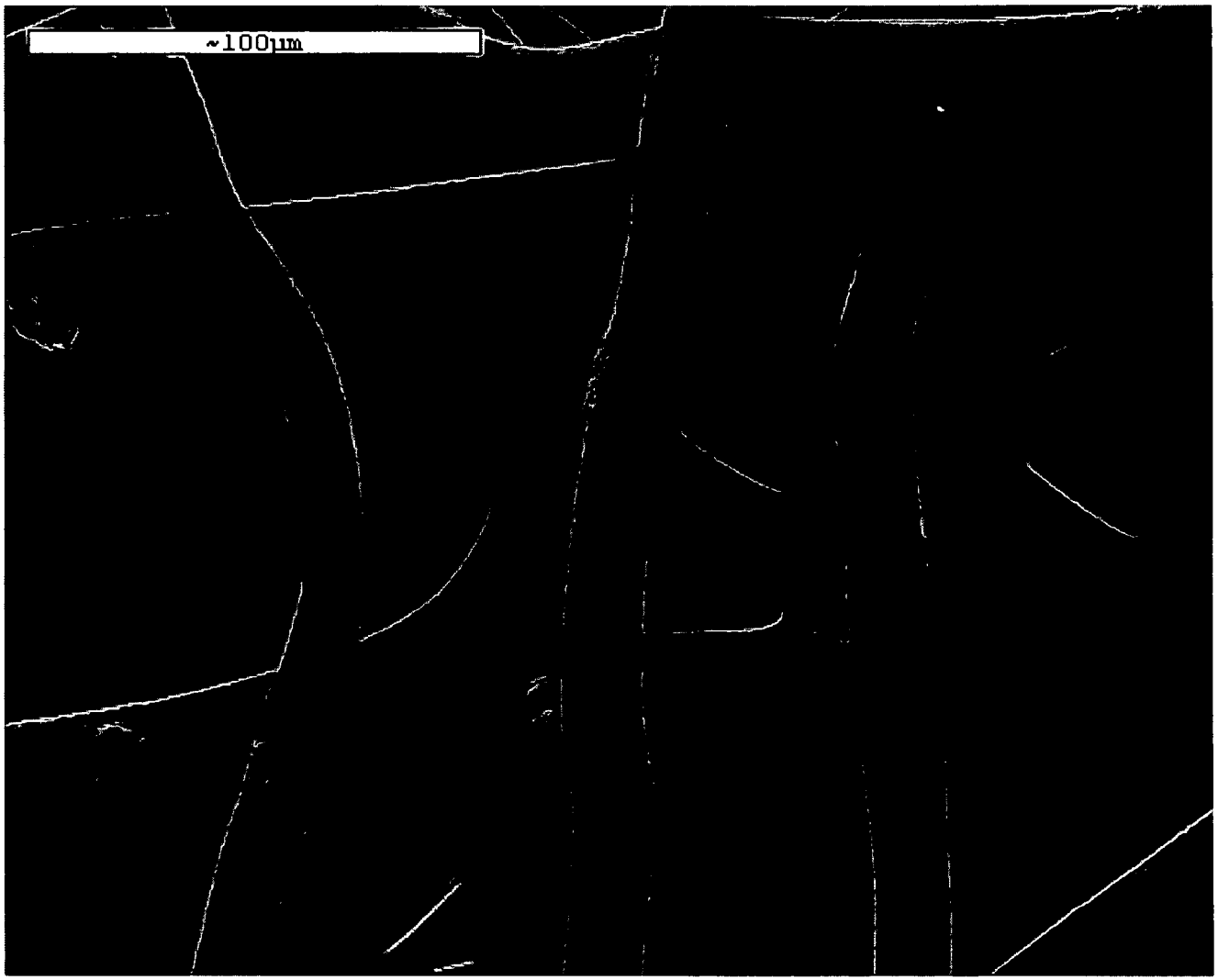
FIG. 9 shows a magnified portion of the surface of a thru-air bonded 108 island spunbonded fabric demonstrating fiber to fiber bonding.
Figure 10:
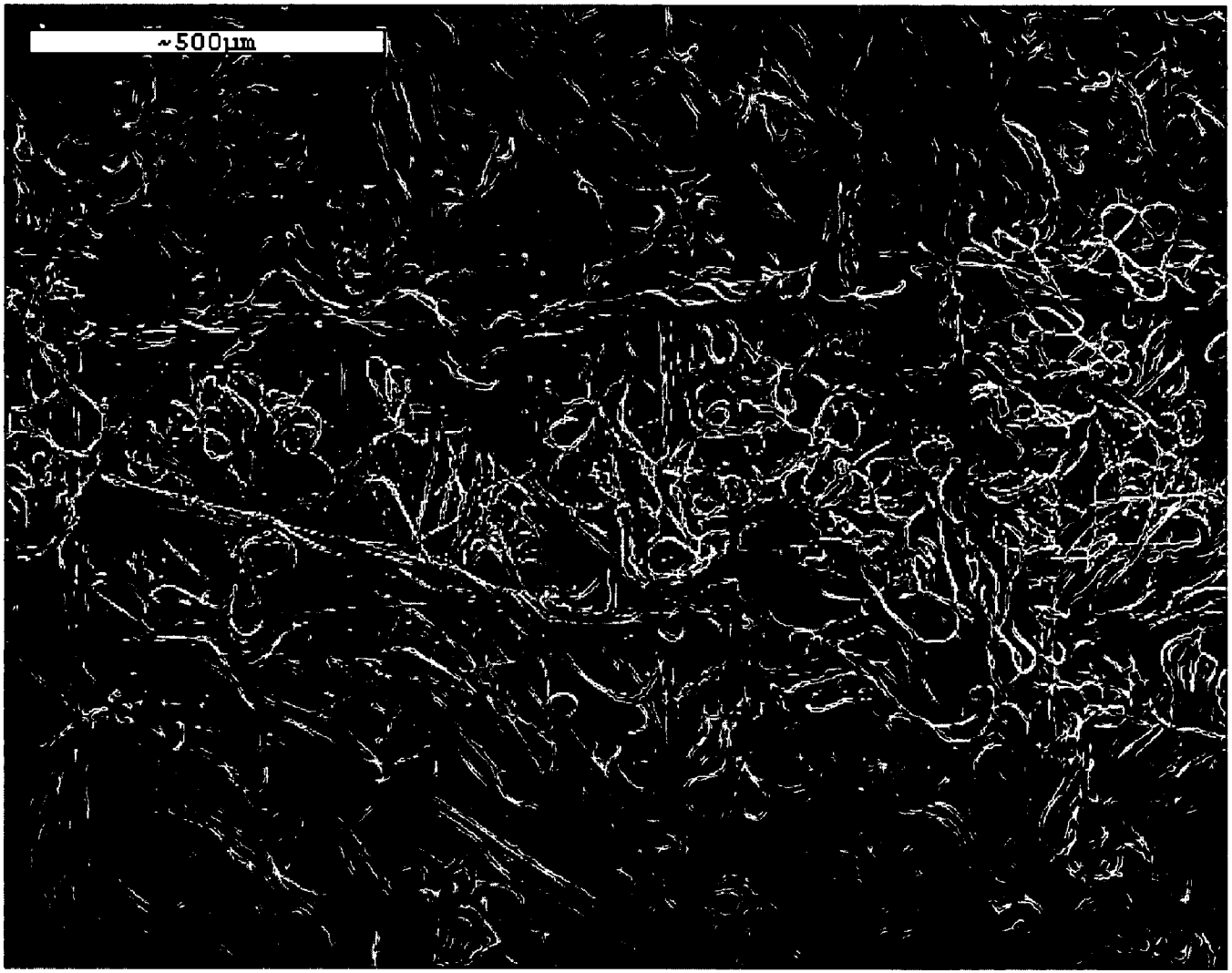
FIG. 10 shows SEM Micrographs of the surface of a hydroentangled thru-air bonded 108 island spunbonded fabric.

A nonwoven fabric is manufactured utilizing a bicomponent fiber structure. The bicomponent fiber structure consists of two distinct fiber compositions which are produced preferably utilizing spun bound technology with an external fiber component enwrapping a second internal fiber component. Such construct is known as sheath/core or islands-in-sea fibers. A sheath/core consists of a single sheath, external, fiber enwraps a single core, internal, fiber. In the islands-in-sea construction a single sea, external, fiber enwraps a plurality of islands, internal, fibers. Examples of the fibers are shown in FIG. 5. The internal core or islands fiber component is circumferentially enwrapped by the external sheath or sea fiber component. With this configuration, the method of the invention includes the step of forming a single or more layers of spunbonded filaments wherein the fibers or filaments are bicomponent with two polymers.

The subject matter disclosed herein relates to methods for improving the bonding process between respective bicomponent fibers where the fabric failure is not dictated by the properties of the fiber-bond interface. In a thermally bonded nonwoven composed of homocomponent fibers, the fibers lose their properties at the bond-fiber interface as well as in the bond because of partial melting of the fibers, as well as potential deformations brought about locally. The changes in the mechanical properties and due to high stress concentrations at the fiber bond interface, the nonwoven tends to fail prematurely.

The inventors have discovered that in a bicomponent fiber in the form of sheath-core or islands-in-sea, the properties can be enhanced when the external and internal fiber components are sufficiently different in their melt properties and the external fiber is completely melted at a bond point. Additionally, the bicomponent fibers must have certain differing characteristics. The sheath or sea component must have a melting temperature which is lower than the core or island component. This difference should be at least fifteen degrees Celsius and is preferably twenty degrees Celsius or more. At the bond point, the external fiber of at least two adjoining fibers are completely melted forming a matrix which encapsulates the internal fiber. When the bicomponent fibers utilized are of the islands-in-sea configuration, the entire sea is melted and most preferably, the entire sea of two adjoining fibers is completely melted. Hence, for bicomponent fibers utilizing islands-in-sea, it is feasible to melt the sea component even in locations which are not bonded with adjacent fibers.

Additionally, to improve spinnability of said bicomponent fibers, it is preferred that the thermoplastic materials also have different viscosity values. Also, the viscosity of the sheath or sea component must be equal or greater than the core or island component. Preferably the external fiber has a viscosity of about one and a half times than that of the internal fiber. Best results have been obtained when the external fiber has a viscosity of twice the internal fiber. Such differential in viscosities enables the matrix to be formed in a manner conducive to forming the high strength fiber of the invention.

Also, the two components forming the internal and external portions of the fibers preferably have different elongation to break values. A suitable measurement of elongation to break values may be obtained utilizing ASTM standard D5034-95. The internal fiber preferably has an elongation to break value less than the external fiber. Preferably, the internal fiber has an elongation to break value at least thirty percent less than the external fiber. For instance the external fiber may have an elongation to break value of fifty percent and the internal fiber has an elongation to break value of thirty percent. This difference facilitates in the shear and tensile forces applied to the nonwoven fabric to be transferred to the internal (stronger) fiber through the matrix (weaker) thereby enhancing the bond strength of the fibers.

While the invention can be maintained by forming a matrix, with additional strength being obtained with either the viscosity of the fibers being different or the elongation to break of the fibers being different, best results have been obtained by forming a matrix with an internal fiber being more viscous than the external fiber and the internal fiber having a lower elongation to break value.

Figure 1:
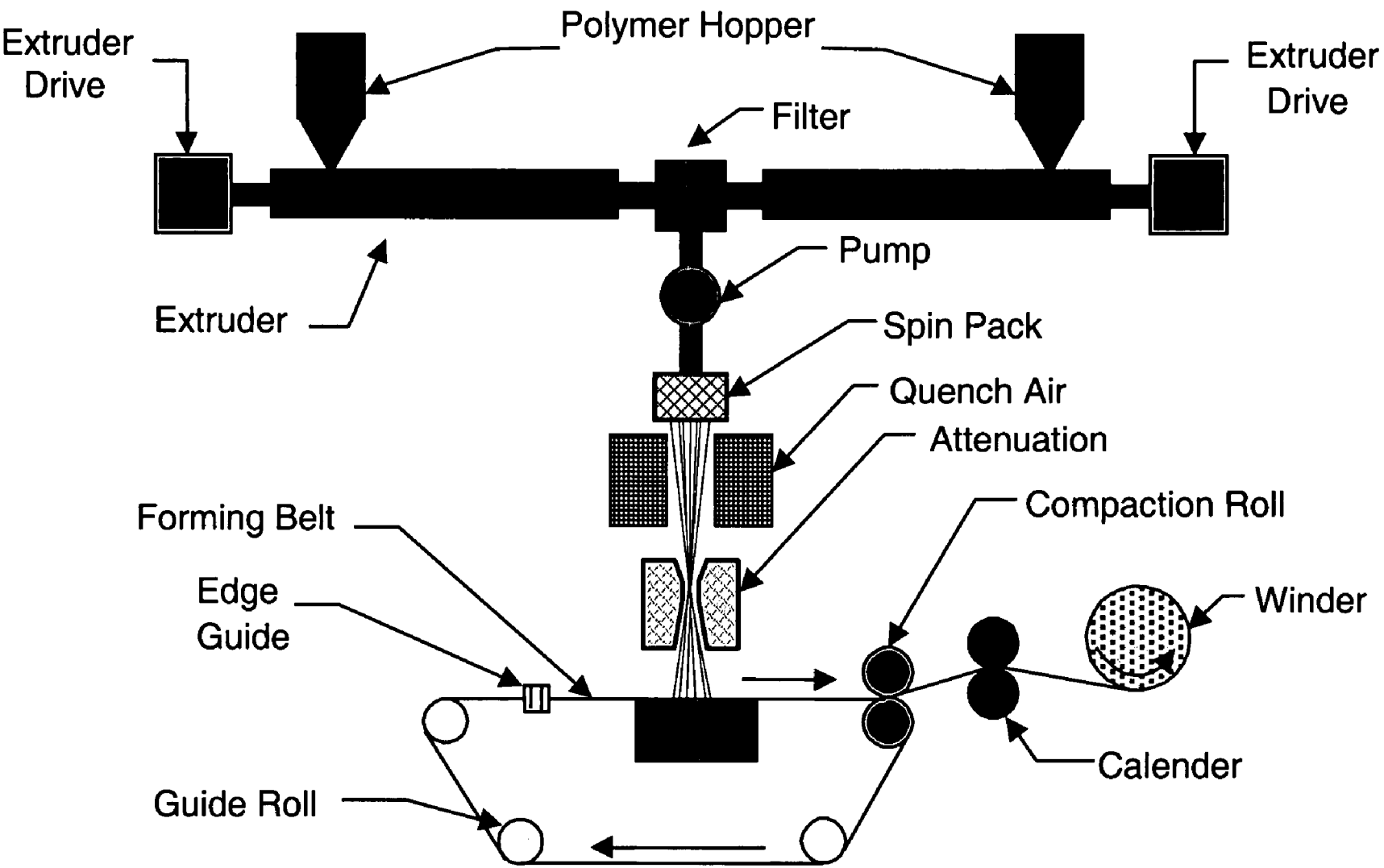
FIG. 1 is schematic drawing of typical bicomponent spunbonding process.

FIG. 1. illustrates the typical spunbond process. In a spunbonded process, small diameter fibers are formed by extruding molten thermoplastic material as filaments from a plurality of fine capillaries of a spinneret having a circular or other configuration, with the diameter of the extruded filaments then being rapidly reduced. As shown in FIG. 1, a first component thermoplastic is positioned in a first polymer hopper and a second component thermoplastic is positioned in a second polymer hopper. The components are then pumped through a spin pack and joined together to form a conjugate fiber. This conjugate fiber is quenched and attenuated and positioned onto a forming belt. The fiber is then bonded.

In the preferred embodiment, the external fiber component thermoplastic is utilized to form an external sheath or sea for the fiber and the internal fiber component thermoplastic is utilized to form the internal core or islands. Examples of polymer components desired to be utilized for the sea are polyethylenes, linear low density polyethylenes in which the alpha-olefin comonomer content is more than about 10% by weight, copolymers of ethylene with at least one vinyl monomer, copolymers of ethylene with unsaturated aliphatic carboxylic acids.

Additionally, for the sea component and/or island component other preferred thermoplastics include those wherein the polymers are selected from the group of thermoplastic polymers wherein said thermoplastic polymer is selected from nylon 6, nylon 6/6, nylon 6,6/6, nylon 6/10, nylon 6/11, nylon 6/12 polypropylene or polyethylene. Additionally, other suitable thermoplastics include those wherein the thermoplastic polymer is selected from the group consisting of: polyesters, polyamides, thermoplastic copolyetherester elastomers, polyolefines, polyacrylates, and thermoplastic liquid crystalline polymers. Preferably, the thermoplastics include those wherein the polymers are selected from the group of thermoplastic polymers comprising a copolyetherester elastomer with long chain ether ester units and short chain ester units joined head to tail through ester linkages. More preferably, the polymers for the core, the islands, the sheath or the sea are selected from the group of thermoplastic polymers fabricated in a temperature range of 50 C. to 450 C.

The shape of the core or islands filaments may be circular or multi-lobal. Furthermore, when the bicomponent fiber is of an islands in sea configuration, the islands may consist of fibers of different materials. For instance, certain polymers may be incorporated to contribute to wettability of the nonwoven web. These thermoplastics may include without limitation polyamids, polyvinyl acetates, saponified polyvinyl acetates, saponified ethylene vinyl acetates, and other hydrophilic materials. Polymers are generally considered to contribute to a nonwoven fabrics wettability if a droplet of water is positioned on a nonwoven web made from the conjugate filaments containing the respective polymeric components and has a contact angle which is a) less than 90 degrees measured using ASTM D724-89, and b) less than the contact angle of a similar nonwoven web made from similar filaments not containing the wettable thermoplastic.

Additionally, polymers may be included which contribute elastic properties to the thermoplastic nonwoven web. Such polymers include without limitation styrene-butadiene copolymers; elastomeric (single-site, e.g. metallocene-catalyzed) polypropylene, polyethylene, and other metallocene-catalyzed alpha-olefin homopolymers and copolymers having densities less than about 0.89 grams/cc; other amorphous poly alpha-olefins having density less than about 0.89 grams/cc; ethylene vinyl acetate, copolymers; ethylene propylene rubbers; and propylene-butene-1 copolymers and terpolymers.

Once the multicomponent fiber has been spunbond, it is placed onto a belt to create substantially continuous filaments of fibers. A substantially continuous filament of fibers refers to filaments or fibers prepared by extrusion from a spinneret, which are not cut from their original length prior to being formed into a nonwoven web or fabric. Substantially continuous filaments or fibers may have average lengths ranging from greater than about 15 cvm to more than one meter, and up to the length of the nonwoven web or fabric being formed. The definition of "substantially continuous filaments or fibers" includes those which are not cut prior to being formed into a nonwoven web or fabric, but which are later cut when the nonwoven web or fabric is cut. The substantially continuous filament of fibers form a nonwoven web on the belt and are bonded to create a nonwoven fabric.

Figure 2:
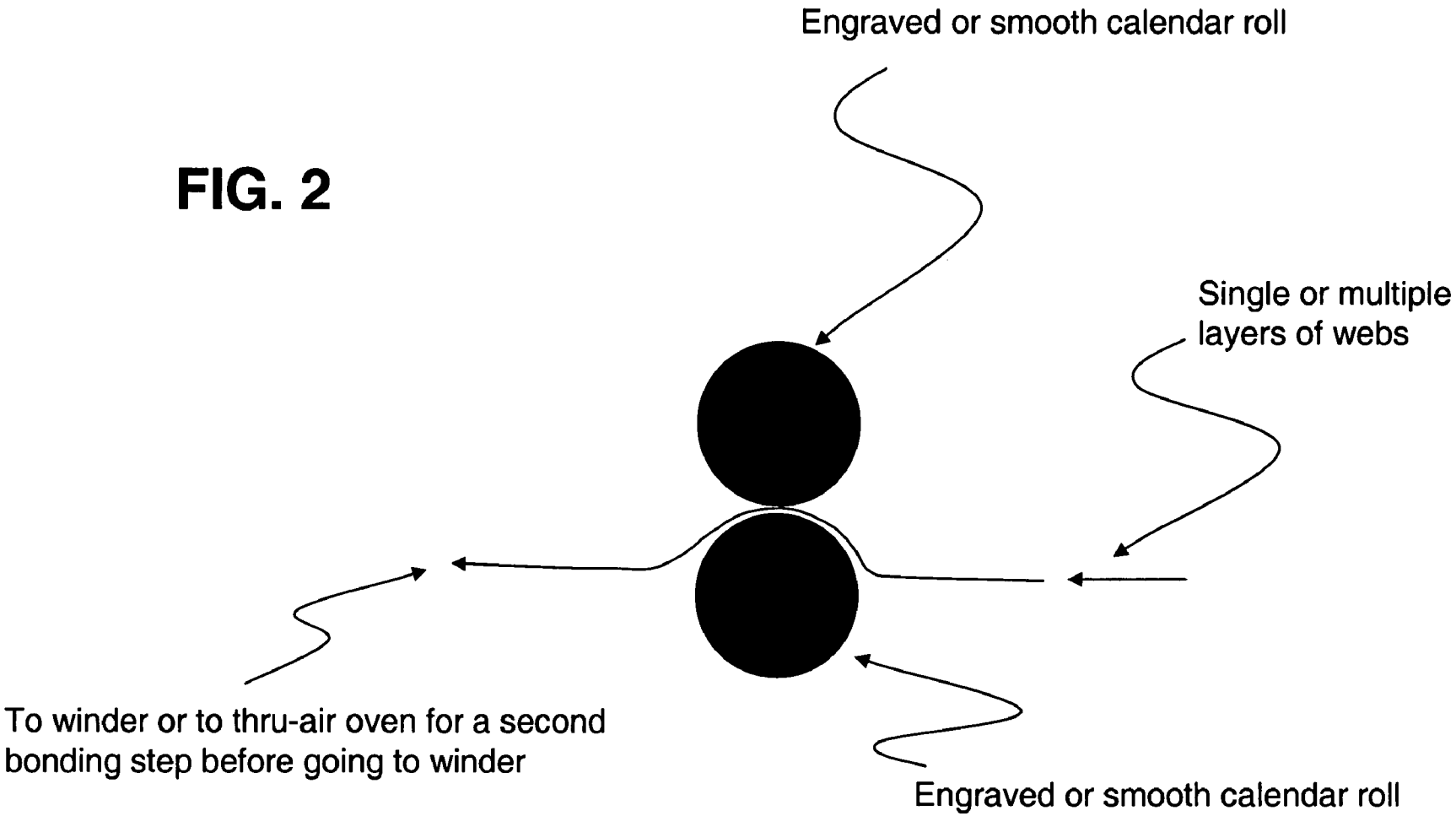
FIG. 2 is schematic drawing of typical calendar bonding process.
Figure 3:
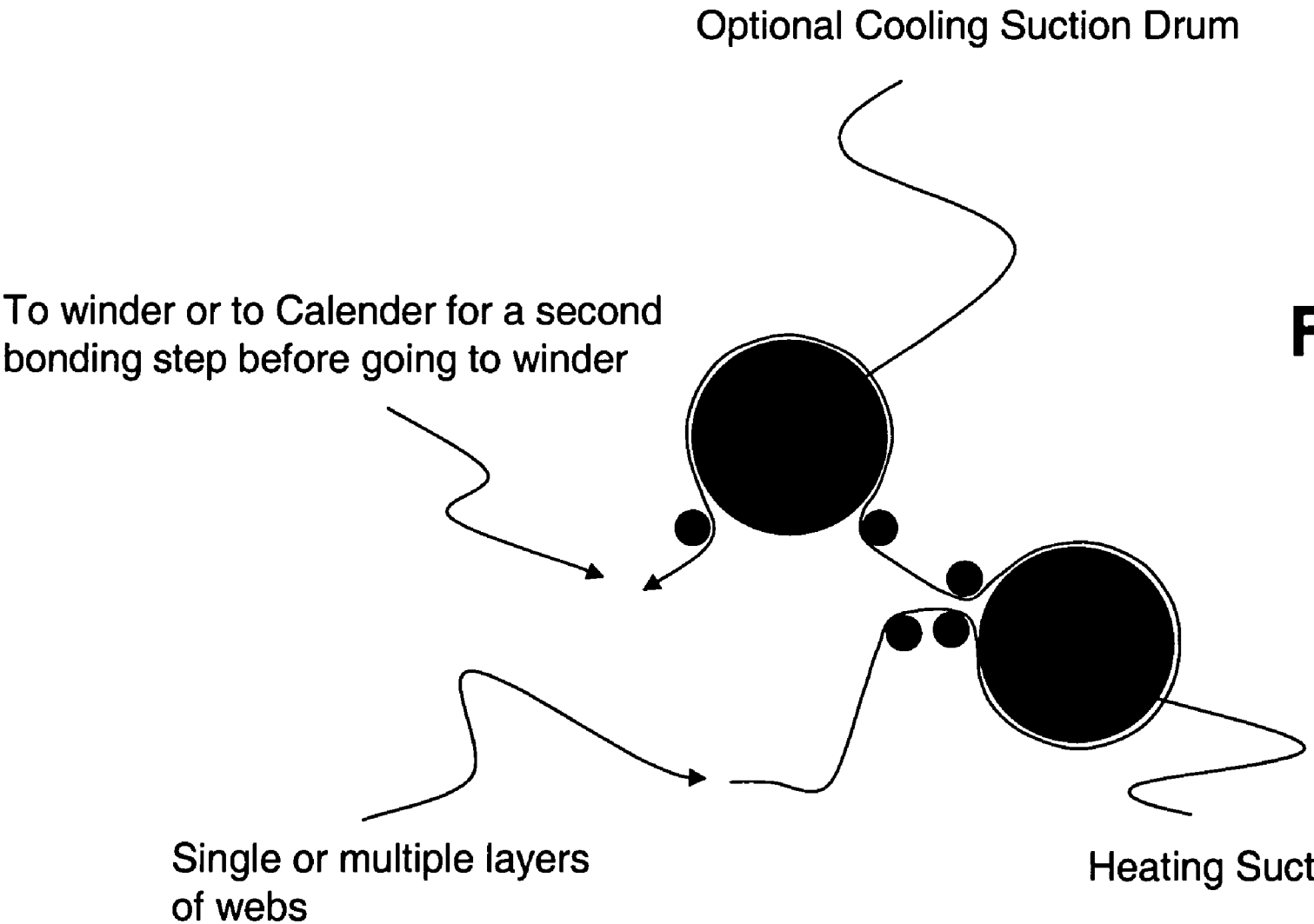
FIG. 3 is schematic drawing of typical single drum thru-air bonding oven.

Depending on the ultimate utilization of the nonwoven fabric, the substantially continuous fibers may be subjected to varying processes. If the highest strength nonwoven fabric is desired, the fibers will be subjected to thermal bonding via a smooth calendar. Alternately, the fabric may be subject to thermal bonding via point bonding. If a more flexible nonwoven fabric of high strength is desired, the fibers may be subjected to thermal bonding via thru air. For the thermal bonding process, the temperature of the fabric does not exceed the melting point of the sea or sheath by more than the difference than the melting point of the islands or core. For instance, in the preferred embodiment, the external component has a melting temperature which is twenty to a hundred and fifty degrees Celsius lower than the melting temperature of the internal fiber. Consequently, the fabric surface temperature would not exceed the melting point of the external fiber by more than twenty degrees in the first instance or a hundred and fifty degrees in the second instance. FIG. 2 is a schematic of a typical calendar bonding process. FIG. 3 illustrates a typical single drum thru-air bonding oven.

Figure 4:
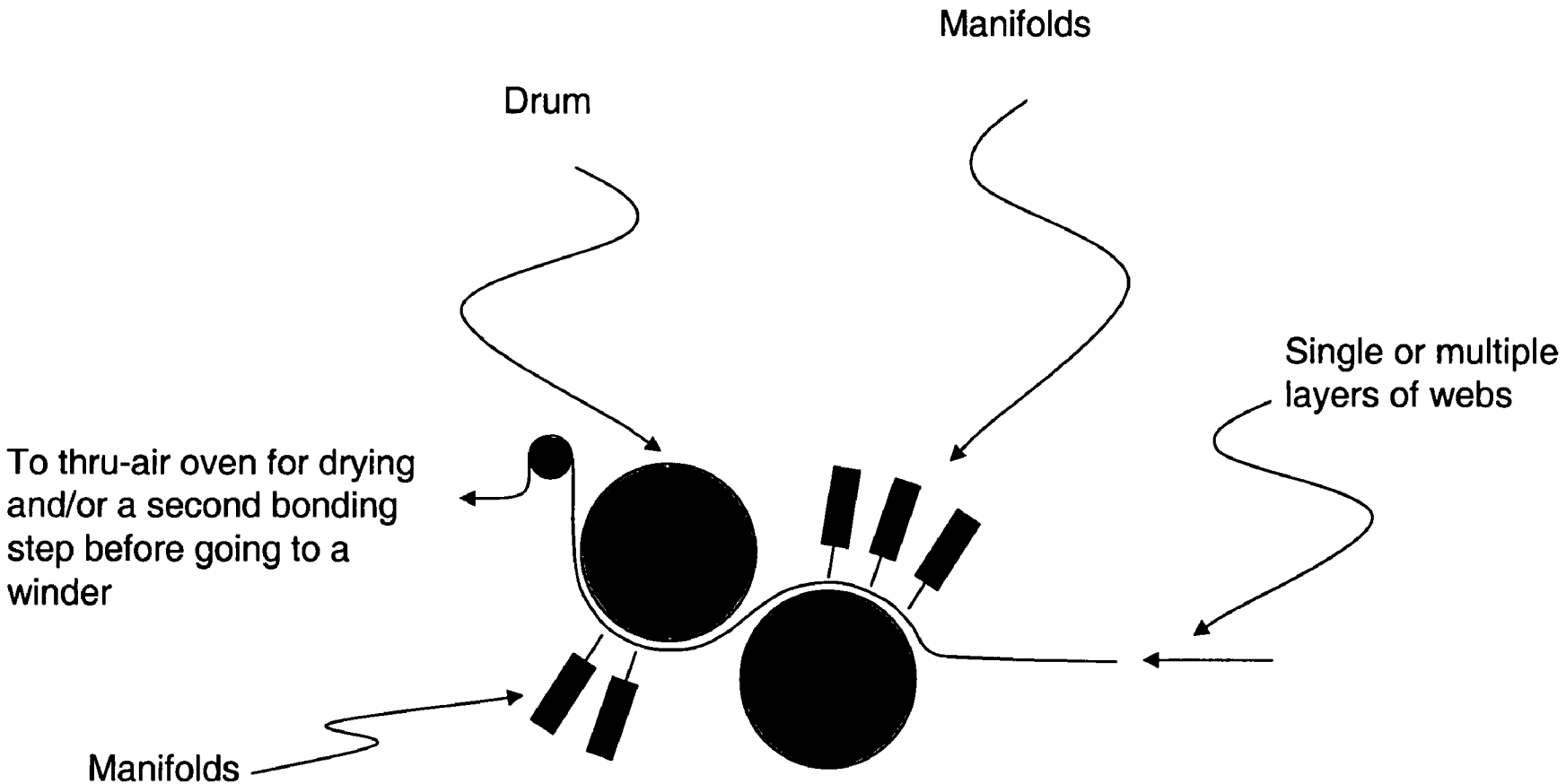
FIG. 4 is a schematic drawing of a typical drum entangling process.

If even a more flexible fabric of high strength is desired, the fibers may first be subjected to hydroentangling prior to being thermally bonded either via thru hot air or a smooth calendar. However, the inventors have discovered that in fabrics that are about 5 ounces per square yard or heavier, hydroentangled webs can lose their properties because of de-lamination at hydroentangling pressures of up to 250 bars. Therefore, for larger structures, a combined process where the structure needle punched, is hydroentangled and is subsequently thermally bonded, may be preferable. In one configuration the nonwoven fabric is exposed to the hydroentanglement process. In another, only one surface of the fabric is exposed to the hydroentanglement process. For the hydroentanglement process, the water pressure of corresponding manifolds preferably is between ten bars and one thousand bars. FIG. 4 illustrates a typical drum entangling process.

Additionally, the surface of the nonwoven fabric may be coated with a resin to form an impermeable material. Also, the resultant fabric may be post-processed after bonding with a dye process.

As described in the background, a nonwoven fabric may fail due to either shear forces or tensile forces rupturing the fibers themselves or the fiber bonds. Applicants' have discovered a bonding process which enables a multi-component nonwoven fabric to exhibit strength at least four times greater than similarly bonded monofilament fabrics.

The thermal bonding mechanism is one where the lower melting point sea or sheath melts and protects the islands or the core. Consequently, there is little or no damage to the islands and the sea acts as a binder or a matrix holding the structure together transferring the stress to the stronger core fibers. FIGS. 6-10 shown scanning electron microscope images of bond interfaces of a hundred and eight islands-in-sea bicomponent fiber consisting of nylon islands enwrapped by a polyethylene sea. As shown by these images, the fibrous structures of the islands are preserved. This will be expected to result in higher tensile properties. Similarly, when the tear propagates through the fabric, the islands will be released, bunch together and help absorb energy resulting in high tear properties.

Tests have shown that the invention results in a calendered nonwoven fiber having a tongue tear strength four times greater in the machine direction and twice as great in the cross direction than a similarly bonded homogeneous nylon fiber and a grab tensile strength one and a half times greater in the machine direction and almost four times as great in the cross direction.

EXAMPLES

Several examples are given below demonstrating the properties of the fabrics produced.

All fabrics weighed about 180 g/m$^2$.

Example 1

100% Nylon Hydroentangled Samples at Two Energy Levels

| Bonding | Specific Energy [kJ/kg] | Calender Temperature [C.] | MD Mean | Standard Error | CD Mean | Standard Error |
|---|---|---|---|---|---|---|
| 100% Nylon - Tongue Tear [lb] | | | | | | |
| Calendered Only | 0 | 200 | 11.90 | 1.99 | 11.04 | 0.79 |
| Hydroentangled Only | 6568.72 | 0 | 16.00 | 1.31 | 15.73 | 2.22 |
| Hydroentangled and Calendered | 6568.72 | 200 | 9.00 | 0.69 | 14.46 | 0.63 |
| 100% Nylon - Grab Tensile [lb] | | | | | | |
| Calendered Only | 0 | 200 | 100.31 | 4.68 | 73.92 | 6.88 |
| Hydroentangled Only | 6568.72 | 0 | 170.34 | 5.17 | 92.58 | 5.35 |
| Hydroentangled and Calendered | 6568.72 | 200 | 157.60 | 6.84 | 81.37 | 6.40 |

Note that for a monofilament, hydroentangled sample appears to have the highest performance. This may be expected because the mechanical bonds do not necessarily influence the fiber's integrity, wherein the thermal bonds create weak spots in the fiber resulting in a weaker structure.

Example 2

75/25% Nylon Islands/PE Sea. 108 islands

| Bonding | Specific Energy [kJ/kg] | Calender Temperature [C.] | MD Mean | Standard Error | CD Mean | Standard Error |
|---|---|---|---|---|---|---|
| 75/25% Nylon/PE, 108 islands - Tongue Tear [lb] | | | | | | |
| Calendered Only | 0 | 145 | 39.44 | 3.11 | 40.22 | 3.13 |
| Hydroentangled Only | 6568.72 | 0 | 16.00 | 1.31 | 15.73 | 2.22 |
| Hydroentangled and Calendered | 6568.72 | 145 | 38.16 | 2.98 | 28.45 | 0.58 |
| 75/25% Nylon/PE, 108 islands - Grab Tensile [lb] | | | | | | |
| Calendered Only | 0 | 145 | 322.63 | 17.03 | 175.27 | 6.78 |
| Hydroentangled Only | 6568.72 | 0 | 59.32 | 1.83 | 96.94 | 2.35 |
| Hydroentangled and Calendered | 6568.72 | 145 | 231.15 | 8.70 | 128.15 | 17.29 |

Note that the Calendered only appears to be the best in the case of bicomponent fibers and the hydroentangled only sample has the lowest performance.

Example 32

75/25% Nylon islands/PE sea, calendar bonded with varying number of island. 0 islands refers to 100% nylon samples produced at their optimal calendar temperature.

| No. of Islands | MD Mean | Standard Error | CD Mean | Standard Error |
|---|---|---|---|---|
| Tongue Tear [lb] - Calender Bonded at 145 C. | | | | |
| 0 | 11.9 | 1.99 | 11.04 | 0.79 |
| 1 | 28.05 | 1.03 | 34.84 | 1.32 |
| 18 | 34.95 | 0.55 | 27.29 | 0.73 |
| 108 | 39.44 | 3.11 | 40.22 | 3.13 |
| Grab Tensile [lb] - Calender Bonded at 145 C. | | | | |
| 0 | 100.31 | 4.68 | 73.92 | 6.88 |
| 1 | 415.50 | 17.98 | 242.15 | 8.19 |
| 18 | 425.94 | 6.42 | 256.68 | 13.79 |
| 108 | 322.63 | 17.03 | 175.27 | 6.78 |

Note that all islands-in-sea samples are significantly superior to the 100% nylon. The islands only account for 75% of the total fiber mass and are improved by a factor of 4 or more with simple calendar bonding.

Articles which may be manufactured utilizing the high strength bicomponent nonwoven include tents, parachutes, outdoor fabrics, house wrap, awning, and the like.

What is claimed is:

1. A method of producing a nonwoven fabric comprising:

spinning a set of bicomponent fibers comprising an external fiber component and an internal fiber component; wherein said external fiber component enwraps said internal fiber component; said external fiber component having a higher elongation to break value than said internal fiber component; and said external fiber component having a lower melting temperature than said internal fiber component;

positioning said set of bicomponent fibers onto a web; and thermally bonding said set of bicomponent fibers to produce a nonwoven fabric by completely melting an external fiber component of a respective bicomponent fiber of said set of bicomponent fibers at a bond interface with an adjacent bicomponent fiber of the set to form a matrix.

2. The method of claim 1 wherein the melting point of said external fiber component is at least twenty degrees Celsius lower than the melting point of said internal fiber component and said bicomponent fibers are thermally bonded at a temperature such that the temperature of the surface of said bicomponent fibers does not exceed the melting temperature of said internal fiber component.

3. The method of claim 1 wherein said melting point of said external fiber component is at least one hundred and fifty degrees Celsius lower than the melting point of said internal fiber component and said bicomponent fibers are thermally bonded at a temperature such that the temperature of the surface of said bicomponent fibers does not exceed the melting temperature of said internal fiber component.

4. The method of claim 1 wherein said external fiber component is more viscous than said internal fiber component of said bicomponent fiber facilitating in forming said bonding matrix.

5. The method of claim 1 wherein said external fiber component has a lower viscosity than said internal fiber component of said bicomponent fiber.

6. The method of claim 1 including hydroentangling said set of bicomponent fibers prior to thermally bonding.

7. The method of claim 1 wherein said internal fiber component comprises a copolyetherester elastomer with long chain ether ester units and short chain ester units joined head to tail through ester linkages.

8. The method of claim 1 wherein said external fiber component comprises thermoplastics selected from the group consisting of a copolyetherester elastomer with long chain ether ester units and short chain ester units joined head to tail through ester linkages.

9. The method of claim 1 wherein said internal fiber component comprises a polymer selected from the group consisting of nylon 6, nylon 6/6, nylon 6,6/6, nylon 6/10, nylon 6/11, nylon 6/12, polypropylene, and polyethylene.

10. The method of claim 1 wherein said external fiber component comprise polymers selected from the group consisting of nylon 6, nylon 6/6, nylon 6,6/6, nylon 6/10, nylon 6/11, nylon 6/12 polypropylene and polyethylene.

11. The method of claim 1 wherein said external fiber component comprises a polymers selected from the group consisting of: polyesters, polyamides, thermoplastic copolyetherester elastomers, polyolefines, polyacrylates, and thermoplastic liquid crystalline polymers.

12. The method of claim 1 wherein said internal fiber component comprises a polymer selected from the group consisting of polyesters, polyamides, thermoplastic copolyetherester elastomers, polyolefines, polyacrylates, and thermoplastic liquid crystalline polymers.

13. The method of claim 1 wherein said thermally bonding includes subjecting said set of bicomponent fibers to a calendar.

14. The method of claim 13 wherein said thermally bonding includes subjecting said set of bicomponent fibers to a calendar for point bonding said fibers.

15. The method of claim 1 wherein said thermally bonding includes subjecting said set of bicomponent fibers to hot air.

16. The method of claim 1 wherein said thermally bonding includes calendaring said fabric and subsequently presenting hot-air to said fabric.

17. The method of claim 1 wherein said internal fiber component is multi-lobal.

18. The method of claim 1 wherein said internal fiber component includes a plurality of internal fiber components enwrapped by said external fiber component defining an island in the sea bicomponent fiber.

19. The method of claim 18 wherein said internal fiber component includes a plurality of internal fiber components which have different mechanical properties selected from the group consisting of elasticity, wetness, and flame retardation.

20. The method of claim 1 wherein both surfaces of the fabric are exposed to a hydroentanglement process prior to thermally bonding.

21. The method of claim 1 wherein only one surface of the fabric is exposed to a hydroentanglement process prior to thermobonding.

22. The method of claim 20 wherein the water pressure of one or more manifolds utilized in the hydroentanglement process is between 10 bars and 1000 bars.

23. The method of claim 1 wherein the fabric is subjected to a resin creating an impermeable layer on the outer surface of said nonwoven fabric.

24. The method of claim 1 wherein the fabric is dyed.

* * * * *

UNITED STATES PATENT AND TRADEMARK OFFICE

CERTIFICATE OF CORRECTION

PATENT NO. : 7,438,777 B2
APPLICATION NO. : 11/096954
DATED : October 21, 2008
INVENTOR(S) : Pourdeyhimi et al.

It is certified that error appears in the above-identified patent and that said Letters Patent is hereby corrected as shown below:

Column 12:

Line 24: "component comprise polymers" should read

--component comprises a polymer--

Column 12:

Line 28: "component comprises a polymers" should read

--component comprises a polymer--

Signed and Sealed this

Seventeenth Day of February, 2009

John Doll

JOHN DOLL
*Acting Director of the United States Patent and Trademark Office*